US009957938B2

(12) United States Patent
Roseborsky et al.

(10) Patent No.: US 9,957,938 B2
(45) Date of Patent: May 1, 2018

(54) FUEL INJECTOR DEVICE HAVING PIN RETAINER

(71) Applicant: DENSO International America, Inc., Southfield, MI (US)

(72) Inventors: Steve Roseborsky, Kingsville (CA); Dhyana Ramamurthy, Novi, MI (US)

(73) Assignee: DENSO International America, Inc., Southfield, MI (US)

( * ) Notice: Subject to any disclaimer, the term of this patent is extended or adjusted under 35 U.S.C. 154(b) by 0 days. days.

(21) Appl. No.: 14/944,522

(22) Filed: Nov. 18, 2015

(65) Prior Publication Data

US 2017/0138325 A1 May 18, 2017

(51) Int. Cl.

| | |
|---|---|
| ***F02M 61/14*** | (2006.01) |
| ***F02M 63/02*** | (2006.01) |
| ***F02M 55/02*** | (2006.01) |
| ***F02M 69/46*** | (2006.01) |

(52) U.S. Cl.

CPC ..... *F02M 61/14* (2013.01); *F02M 55/025* (2013.01); *F02M 63/0275* (2013.01); *F02M 69/465* (2013.01); *F02M 2200/851* (2013.01); *F02M 2200/853* (2013.01); *F02M 2200/856* (2013.01); *F02M 2200/857* (2013.01)

(58) Field of Classification Search

CPC .. F02M 61/14; F02M 63/0275; F02M 69/465; F02M 55/025; F02M 2200/857; F02M 2200/856; F02M 2200/851; F02M 2200/853

USPC ..... 123/470

See application file for complete search history.

(56) References Cited

U.S. PATENT DOCUMENTS

| | | | | |
|---|---|---|---|---|
| 2,310,490 | A * | 2/1943 | Melsom | F16L 19/0231 285/131.1 |
| 3,527,485 | A * | 9/1970 | Goward | F16L 37/144 285/305 |
| 4,346,846 | A * | 8/1982 | Eblen | F02M 61/14 239/533.3 |
| 5,909,725 | A * | 6/1999 | Balsdon | F02M 25/0836 123/470 |
| 7,556,022 | B1 * | 7/2009 | Doherty | F02M 55/004 123/456 |
| 7,802,559 | B2 * | 9/2010 | Furst | F02M 61/14 123/470 |
| 7,856,962 | B2 * | 12/2010 | Harvey | F02M 55/025 123/470 |
| 8,479,710 | B2 * | 7/2013 | Davis | F02M 61/168 123/470 |
| 8,646,434 | B2 * | 2/2014 | Harvey | F02M 55/005 123/456 |
| 8,813,722 | B2 * | 8/2014 | Harvey | F02M 55/005 123/456 |
| 2016/0025053 | A1 * | 1/2016 | Reinhardt | F02M 61/14 239/584 |

(Continued)

FOREIGN PATENT DOCUMENTS

DE 102004037117 A1 3/2006

*Primary Examiner* — Hai Huynh

(57) ABSTRACT

An injector has an inlet body. A cup is in a bottomed tubular shape to hold the inlet body. The cup has a sidewall defining first apertures and second apertures. A first pin is inserted in the first apertures. A second pin is inserted in the second apertures. The first pin and the second pin are configured to hold the inlet body and to restrict rotation of the inlet body relative to the cup.

14 Claims, 13 Drawing Sheets

(56) References Cited

U.S. PATENT DOCUMENTS

2016/0273501 A1* 9/2016 Cass ..... F02M 61/14
2016/0333836 A1* 11/2016 Lang ..... F02M 55/005

* cited by examiner

FUEL INJECTOR DEVICE HAVING PIN RETAINER

TECHNICAL FIELD

The present disclosure relates to a fuel injector device having a pin retainer.

BACKGROUND

Conventionally, a fuel rail may be equipped to an internal combustion engine. A fuel rail may be equipped with a fuel injector to inject fuel into a combustion chamber of an engine. A fuel rail may employ a structure to receive a fuel injector.

SUMMARY

According to an aspect of the preset disclosure, an injector may have an inlet body. A cup may be in a bottomed tubular shape and may be configured to hold the inlet body. The cup may have a sidewall defining first apertures and second apertures. A first pin may be inserted in the first apertures. A second pin may be inserted in the second apertures. The first pin and the second pin may be configured to hold the inlet body and to restrict rotation of the inlet body relative to the cup.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION

First Embodiment

As follows, a first embodiment of the present disclosure will be described with reference to drawings. In the description, a vertical direction is along an arrow represented by "VERTICAL" in drawing(s). An axial direction is along an arrow represented by "AXIAL" in drawing(s). A longitudinal direction is along an arrow represented by "LONGITUDINAL" in drawing(s). A width direction is along an arrow represented by "WIDTH" in drawing(s). A radial direction is along an arrow represented by "RADIAL" in drawing(s). A circumferential direction is along an arrow represented by "CIRCUMFERENTIAL" in drawing(s).

Figure 1:
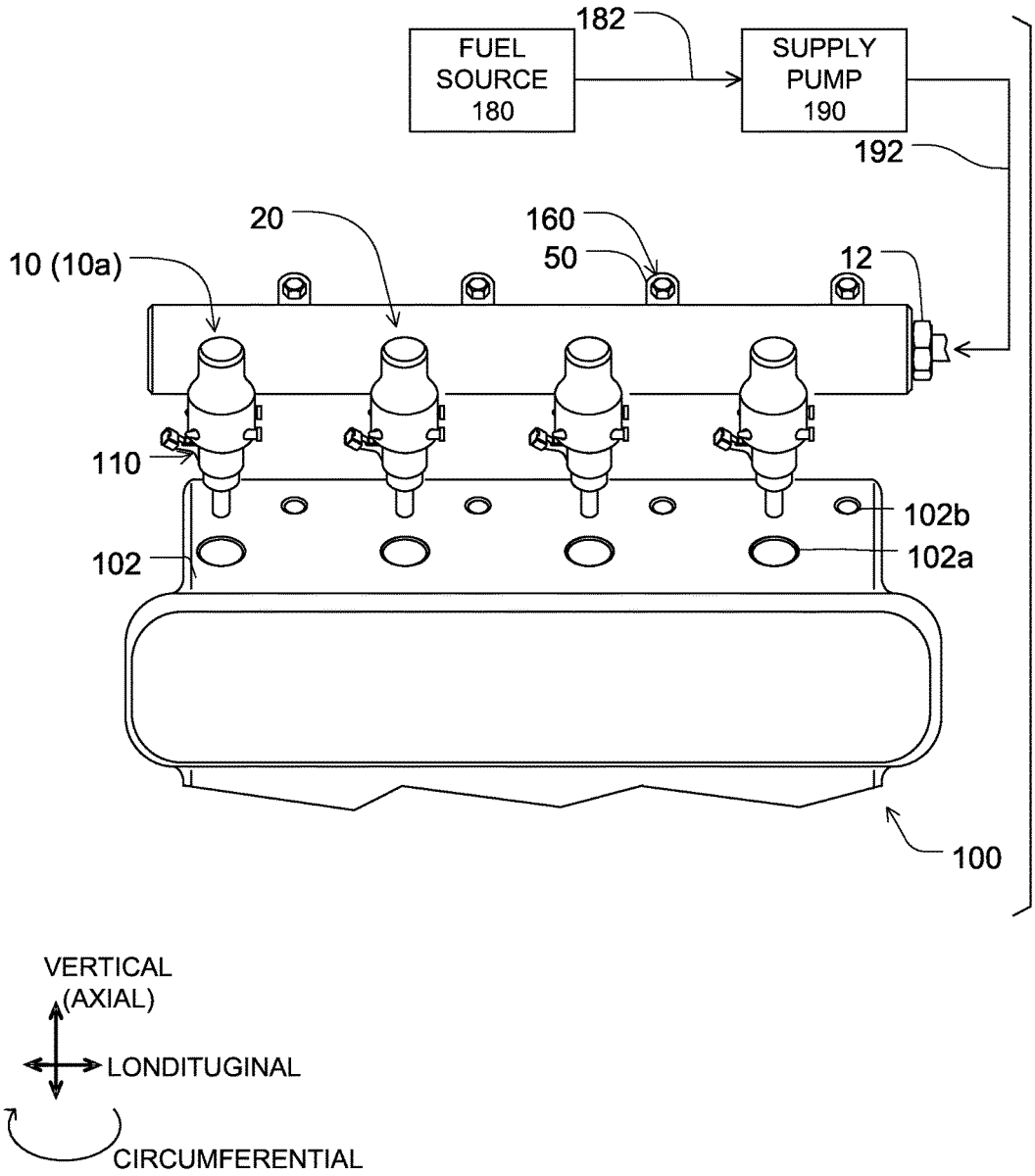
FIG. 1 is a perspective view showing a fuel rail equipped with injector mounting devices and a cylinder head of an engine.

As shown in FIG. 1, an internal combustion engine 100 is equipped with a fuel rail (rail body) 10 equipped with injectors 110. The fuel rail 10 has a fuel inlet 12 and defines a fuel passage 10*a* therein. The fuel inlet 12 may be coupled with a supply pump 190 and a fuel source 180 through pipes 182 and 192. The fuel source 180 may include a fuel tank and a feed pump (not shown). The supply pump 190 may draw fuel from the fuel source 180 and may pressurize the drawn fuel to supply the pressurized fuel through the fuel inlet 12 into the fuel passage 10*a*. The fuel rail 10 is equipped with the injectors 110 and is mounted onto a cylinder head 102 of the internal combustion engine 100. The fuel rail 10 is equipped with injector mounting devices 20 and brackets 50. Specifically, the injector mounting devices 20 are mounted with injectors 110. The brackets 50 may be mounted with fasteners such as screws 160, respectively. The injectors 110 are fitted into injector holes 102*a* of the cylinder head 102. The fuel rail 10 may be affixed to the cylinder head 102 of the engine 100 by screwing the screws 160 through the brackets 50 into screw holes 102*b* of the cylinder head 102. In the example, the engine 100 may be a four-cylinder engine 100, and the fuel rail 10 may be equipped with four injectors 110 via four injector mounting devices 20, respectively.

Figure 2:
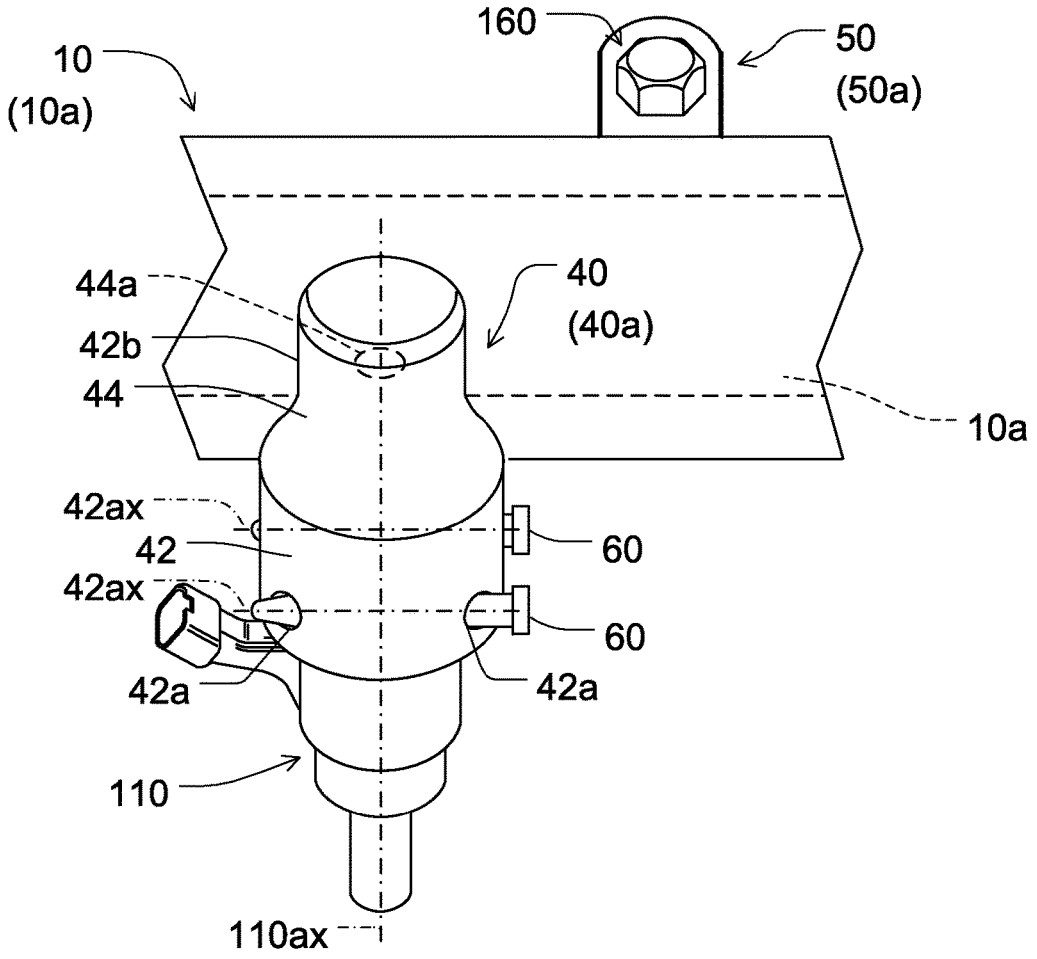
FIG. 2 is a perspective view showing a cup equipped with a fuel injector and pins.
Figure 2:
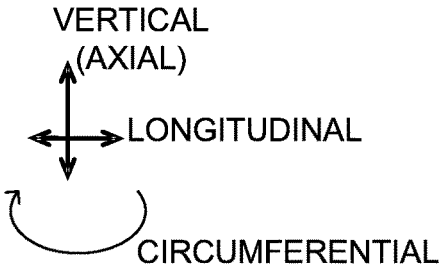

In FIG. 2, the bracket 50 may be extended from a sidewall of the fuel rail 10 perpendicularly to the longitudinal direction of the fuel rail 10. The bracket 50 may be formed of metal such as stainless steel by, for example, forging and/or machining. The bracket 50 may form a screw opening 50*a* configured to receive the screw 160. The bracket 50 may have a top surface, which may function as a seat to receive a screw head of the screw 160.

Figure 3:
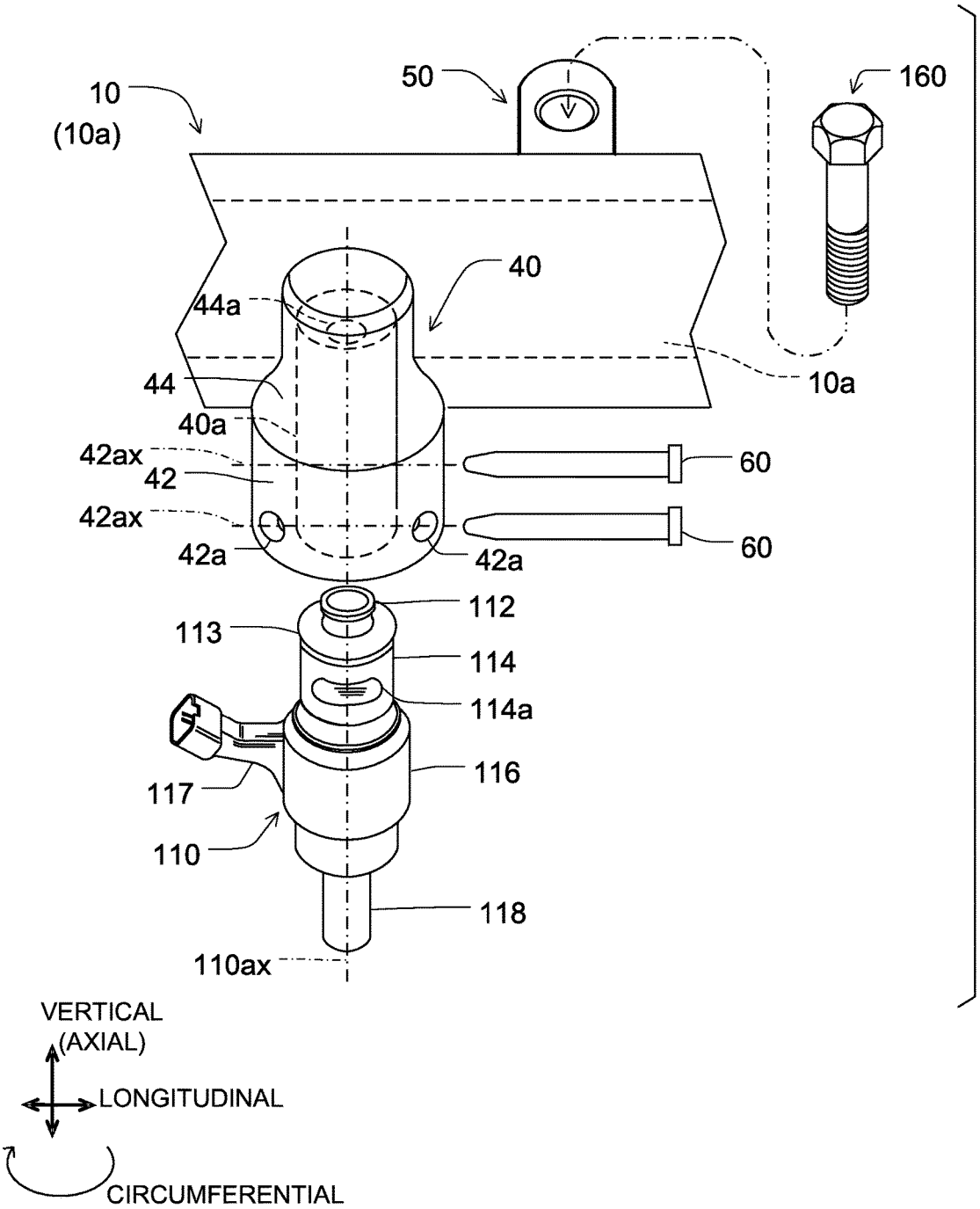
FIG. 3 is an exploded perspective view showing the cup, the injector, and the pins.

FIGS. 2 to 3 show one of the injector mounting devices 20 and the corresponding one injector 110. The injector mounting device 20 includes a cup 40. In FIG. 2, the cup 40 may be in a bottomed tubular shape including a sidewall 42 and a bottom end 44. The sidewall 42 may be in a tubular shape, and the bottom end 44 may be in an elongated hat shape. The sidewall 42 and the bottom end 44 of the cup 40 may be integrally formed as one piece to define an internal space 40*a*. The cup 40 may be formed of metal such as stainless steel by, for example, forging and/or machining. The cup 40 may have an inlet 44*a* as a through hole in the sidewall 42. The internal space 40*a* of the cup 40 may be communicated with the fuel passage 10*a* of the fuel rail 10 through the inlet 44*a*. The cup 40 is configured to receive the injector 110. The cup 40 may define an injector axis 110*ax*. When the cup 40 receives the injector 110, the injector 110 may be aligned with the injector axis 110*ax*.

The bottom end 44 of the cup 40 may have a curved surface 42*b* via which the cup 40 may be affixed to the surface of the fuel rail 10 by, for example, brazing. The cup 40 may be cantilevered from the fuel rail 10, such that the cup 40 may be extended from the fuel rail 10 perpendicularly to the longitudinal direction of the fuel rail 10.

The sidewall 42 of the cup 40 may define two pairs of apertures 42*a*. In FIG. 2, one pair of the apertures 42*a* is shown. The apertures 42*a* may be formed by machining the sidewall 42. For example, a drill may be used to perforate the sidewall 42 on both sides to form the apertures 42*a* on both sides, respectively. The apertures 42*a* may be opposed to each other linearly along an aperture axis 42*ax*. In FIG. 2, the cup 40 receives the injector 110, and the pins 60 are equipped to the cup 40. In the present example, the pins 60 skewer the cup 40. The pair of pins 60 may be separated components from each other. The pair of the apertures 42*a* receives a pin 60. That is, the two pairs of apertures 42*a* receive two pins 60, respectively.

FIG. 3 shows the components before being assembled together. In FIG. 3, the injector 110 may have an inlet end 112, an inlet body 114, an injector body 116, and a nozzle 118, which are extended in this order. The injector 110 is configured to receive fuel through the inlet end 112 and to draw the fuel through the inlet body 114 and the injector body 116. Thus, the injector 110 is configured to inject the fuel form the nozzle 118.

The injector 110 may include a solenoid actuator in, for example, the injector body 116. The solenoid actuator may be configured to manipulate an inner valve (not shown) to control hydraulic pressure applied to an injection needle (not shown) thereby to manipulate the injection needle to implement fuel injection from the nozzle 118 and to stop the fuel injection. The solenoid actuator may be electrically connected with an electric connector 117. The electric connector 117 may be connected with an external power cable to receive electric power supplied from an external power device. The electric connector 117 may be extended from the injector body 116 radially outward. In the present example, the electric connector 117 may be extended along a direction of a recess 114*a*. The inlet end 112 may be equipped with an O-ring 113. The inlet end 112 may be seated within the internal space 40*a* of the cup 40. The O-ring 113 may seal between the inlet end 112 of the injector 110 and the inner periphery of the sidewall 42 of the cup 40 thereby to restrict fuel from leaking out from the internal space 40*a* of the cup 40. The sidewall 42 of the cup 40 may have a dimension to receive the inlet end 112 of the injector 110 such that the inlet end 112 of the injector 110 abuts the inner periphery of the sidewall 42 of the cup 40. In this way, the cup 40 may align the injector 110 along the injector axis 110*ax*. The injector axis 110*ax* may extend through an axial center of both the cup 40 and the injector 110, when the cup 40 receives the injector 110.

Figure 4:
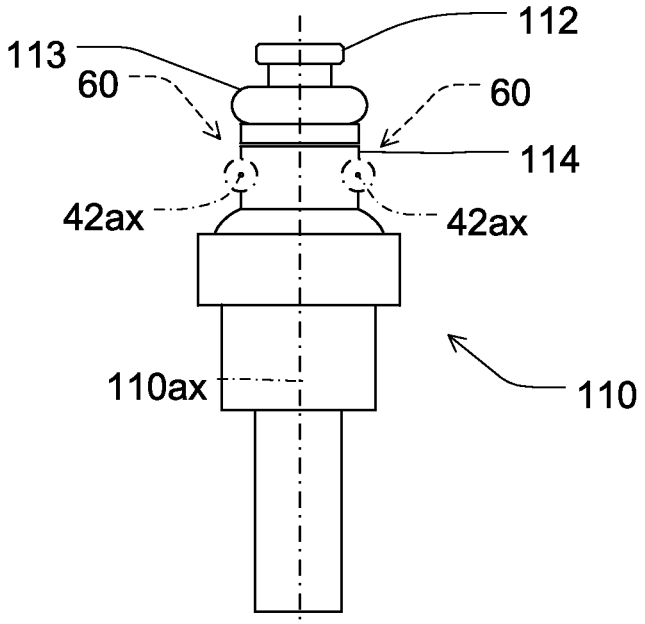
FIG. 4 is a side view showing the injector viewed along aperture axes.
Figure 4:
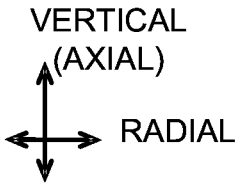
Figure 5:
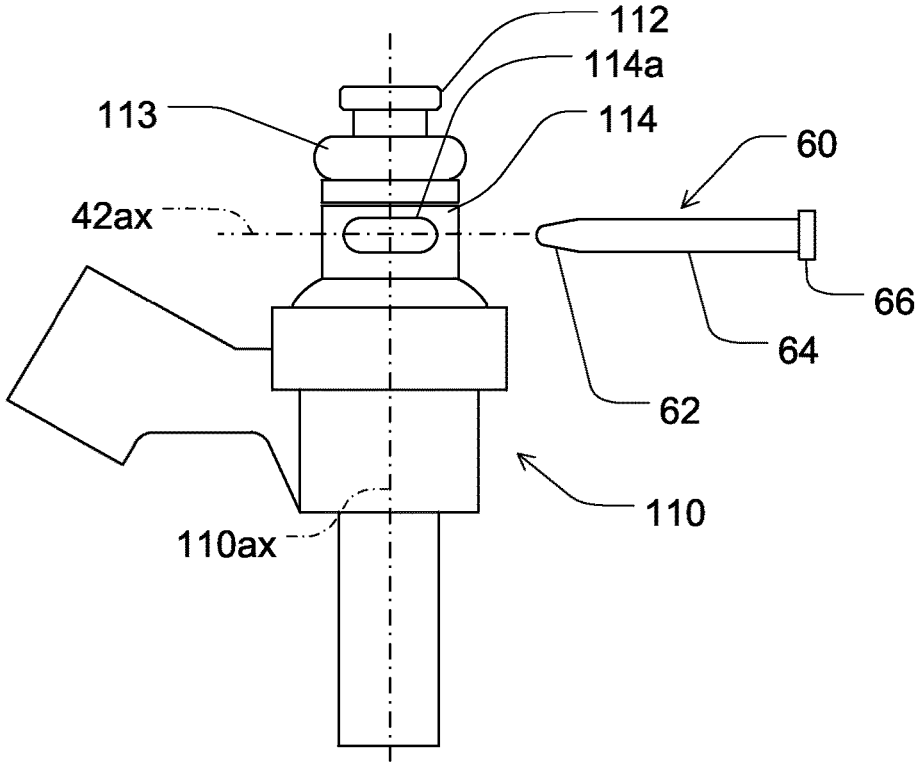
FIG. 5 is a side view showing the injector viewed perpendicularly to the aperture axes.
Figure 5:
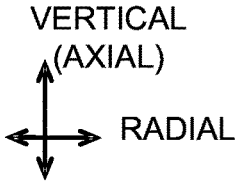

In FIGS. 3 to 5, the inlet body 114 has an outer periphery defining recesses 114*a* (first recess 114*a* and second recess 114*a*) on both lateral sides. The recesses 114*a* may be located closer to the nozzle 118 than the inlet end 112 in the vertical direction. The recesses 114*a* may be at the same level in the vertical direction. Each of the recesses 114*a* may be formed by, for example, machining the outer circumferential periphery of the inlet body 114 to shave the periphery radially inward.

In FIG. 4, the recesses 114*a* may be offset from a center of the injector 110 radially outward in opposite directions. The center of the injector 110 may correspond to the injector axis 110*ax*. Each of the recess 114*a* may be dented from the outer periphery of the inlet body 114 radially inward. The recess 114*a* may be in a shape to correspond to a part of the outer periphery of the pin 60. The recess 114*a* may have a cross section in an arc shape, which coincides with a part of the cross section of the pin 60.

In FIG. 4, the pins 60 are depicted by dotted lines. Each of the pins 60 may have a cross section in a circular shape, correspondingly to the cross section of the recess 114*a*. In the example, the recess 114*a* may have a cross section in a semicircular shape.

In FIG. 5, the recess 114*a* may be in an elongated oval shape. The recess 114*a* may extend linearly in a direction perpendicularly to the injector axis 110*ax*. The pin 60 may be in an elongated bar shape and may extend linearly. The pin 60 may have a pin end 62, a pin body 64, and a pin head 66. The pin body 64 may be in a linear bar shape and may have a circular cross section. The pin end 62 may be located at one end of the pin body 64. The pin end 62 may be reduced in diameter from the pin body 64 toward a tip end of the pin end 62. The pin head 66 may be located at the other end of the pin body 64. The pin head 66 may be in a plate shape having a diameter greater than a diameter of the pin body 64. The pin head 66 may be greater than corresponding one of the first apertures 42*a* and the second apertures 42*a* in size.

Referring to FIG. 3, when the components are assembled together, the injector 110 may be first inserted into the internal space 40*a* of the cup 40. The injector 110 may be aligned relative to the cup 40. Specifically, the recess 114*a* may be aligned with the apertures 42*a* in the vertical direction. In addition, the recess 114*a* may be aligned with the apertures 42*a* in the circumferential direction such that the cross section of the recess 114*a* coincides with the apertures 42*a*. That is, the recess 114*a* may be aligned with the apertures 42*a* to enable insertion of the pin 60. When the recess 114*a* is aligned with the apertures 42*a*, the dented surface of the recess 114*a* and the inner peripheries of the apertures 42*a* may form a linear tunnel to guide the pin 60 therethrough. The pin 60 may be inserted through the apertures 42*a* such that the pin 60 is fitted to the recess 114*a*. The pair of pins 60 may be separated components from each other. Therefore, the pins 60 may be inserted into the apertures 42*a* and equipped to the cup 40 one by one.

Figure 6:
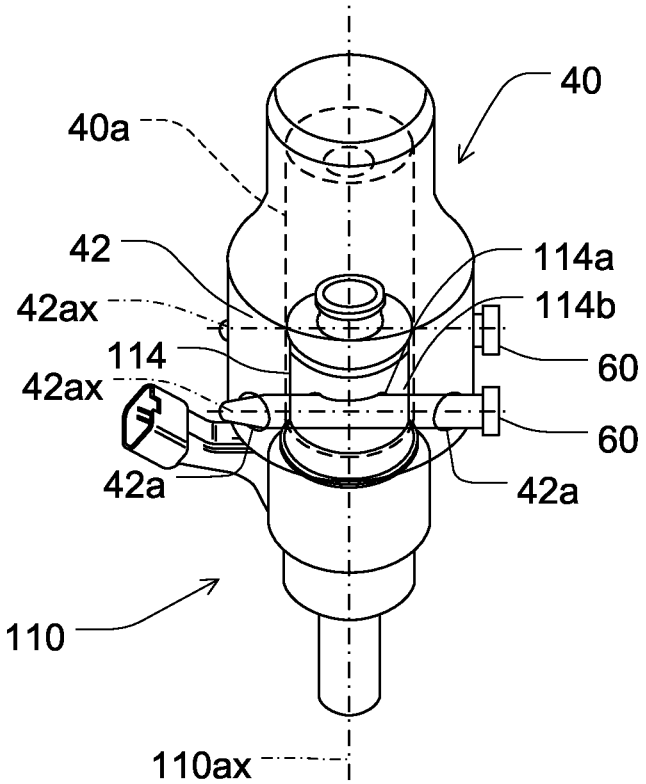
FIGS. 6 and 7 are partial transparent perspective views each showing the cup equipped with the fuel injector and pins.
Figure 6:
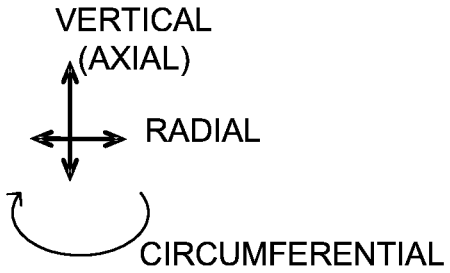
Figure 7:
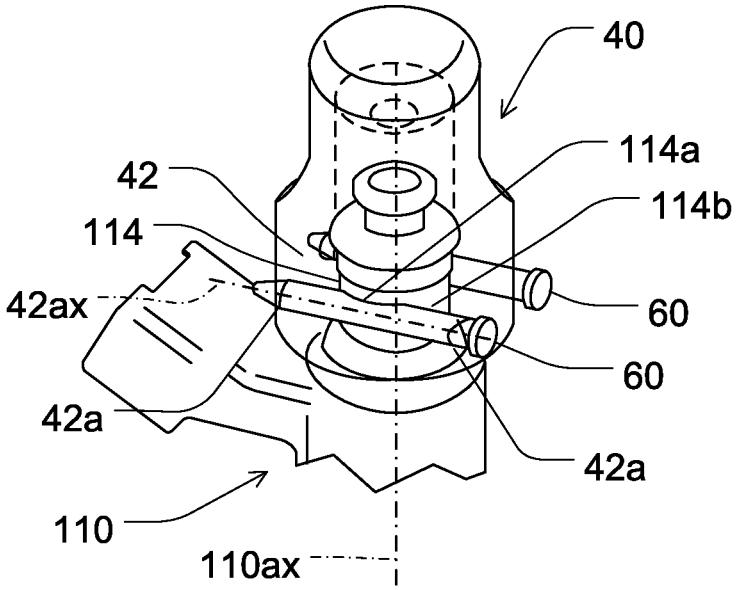
Figure 7:
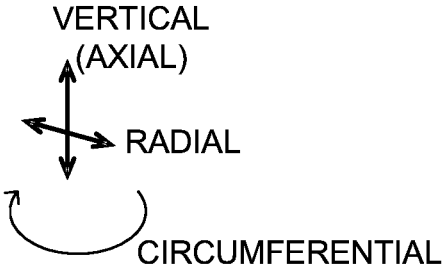

FIGS. 6 and 7 show the components of a fuel injector device assembled together. In FIGS. 6 and 7, the injector 110 and the pin 60 are depicted with solid lines to facilitate understanding the relative relation of the components. Each of the pins 60 are inserted through the corresponding pair of the apertures 42*a* along the aperture axis 42*ax* to pass along the corresponding recess 114*a*. Thus, the pin 60 may be supported by the sidewall 42 at the two positions corresponding to the two apertures 42*a* thereby to sling the inlet body 114 of the injector 110 via the recess 114*a*. In this way, the pin 60 may be inserted through the apertures 42*a* to hold the inlet body 114.

The recesses 114*a* may be formed on the inlet body 114 in a specific region with respect to the circumferential direction. Therefore, the inlet body 114 may have remaining portions 14*b*, which are not dented, excluding the recesses 114*a*. The remaining portions 14*b* may fit to the periphery of the pin 60 thereby to prohibit the injector 110 from rotating relative to the cup 40. In this way, the pin 60 may be fitted to the inlet body 114 via the recess 114*a* to restrict rotation of the injector body 116 relative to the cup 40.

Figure 8:
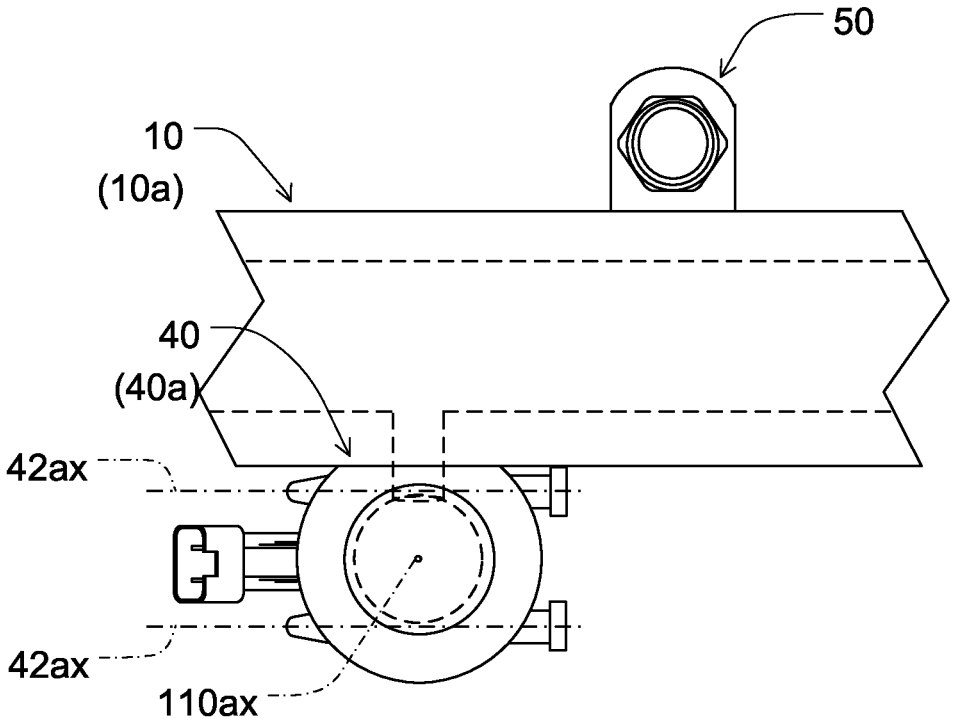
FIG. 8 is a top view showing the fuel rail equipped with the cup, the injector, and the pins.
Figure 8:
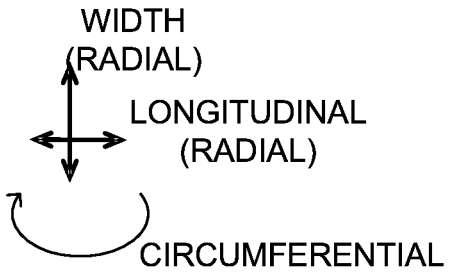
Figure 9:
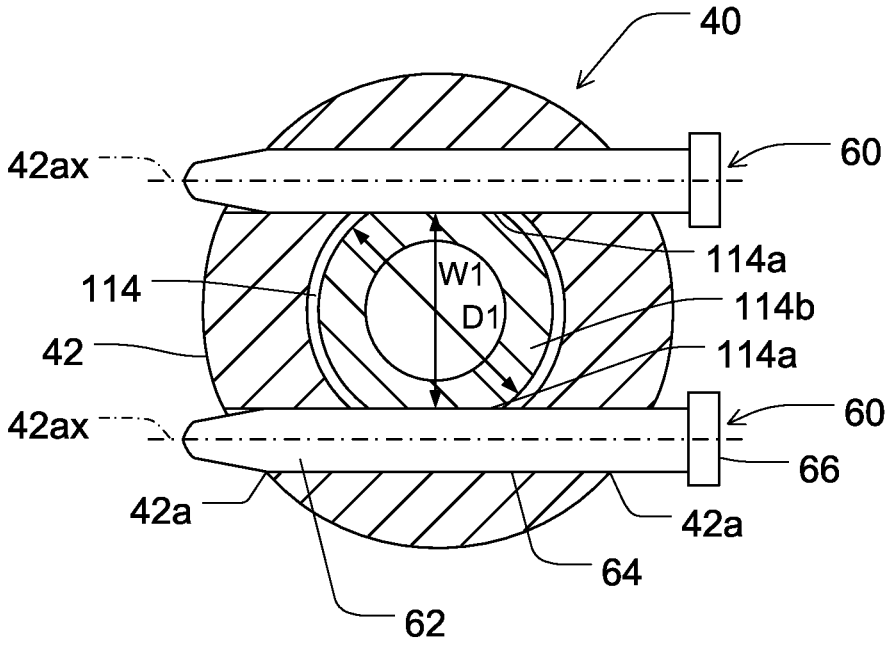
FIG. 9 is a sectional view showing the cup equipped with the injector and the pins.
Figure 9:
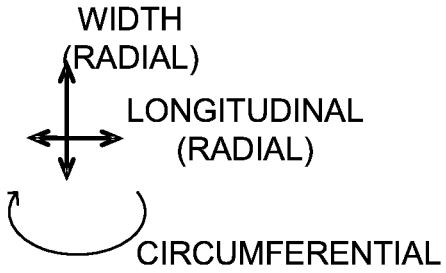

In FIGS. 8 and 9, each of the pairs of the apertures 42*a* may extend through the sidewall 42 of the cup 40 along the aperture axis 42*ax*. The apertures 42*a* and the aperture axis 42*ax* may be offset from the center of the cup 40 radially outward. The center of the cup 40 may correspond to the injector axis 110*ax*. The pin 60 may be inserted through the apertures 42*a* along the aperture axis 42*ax*. In the present example, the corresponding two apertures 42*a* extending along the aperture axis 42*ax* are through holes, and the pins 60 extend through both the corresponding apertures 42*a*.

In FIG. 8, the inlet body 114 has a diameter D1 at the remaining portions 114*b*, excluding the recesses 114*a*. The inlet body 114 has a width W1 at the recesses 114*a*. The diameter D1 may be greater than the width W1. That is, each of the recesses 114*a* is dented from the outer periphery of the inlet body 114 by ((D1−W1)/2).

Second Embodiment

Figure 10:
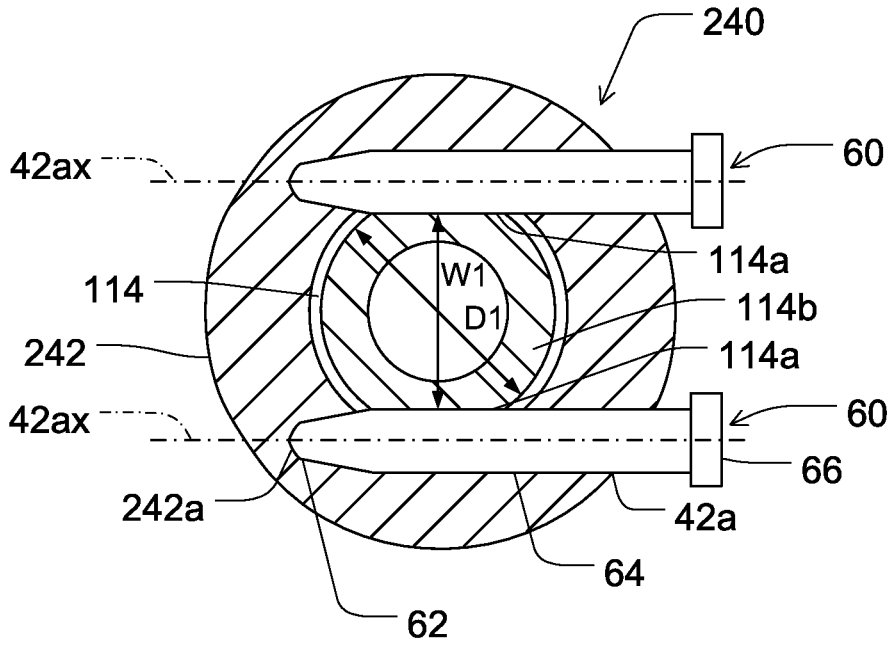
FIG. 10 is a sectional view showing a cup equipped with the injector and the pins, according to a second embodiment.
Figure 10:
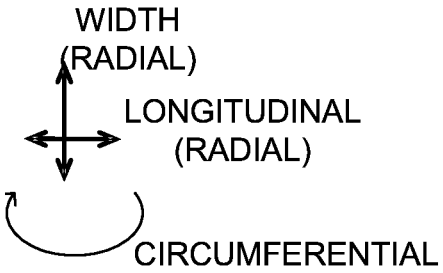

As shown in the example of FIG. 10, the aperture is not limited to a through hole. For example, one aperture 42*a* may be a through hole, and the other aperture 242*a* may be a dent, which opens in an inner periphery of a sidewall 242 of a cup 240. In this case, the pin 60 may extend through the one aperture 42*a* and the pin 60 may reside at the pin end 62 within the other aperture 242*a*.

Third Embodiment

Figure 11:
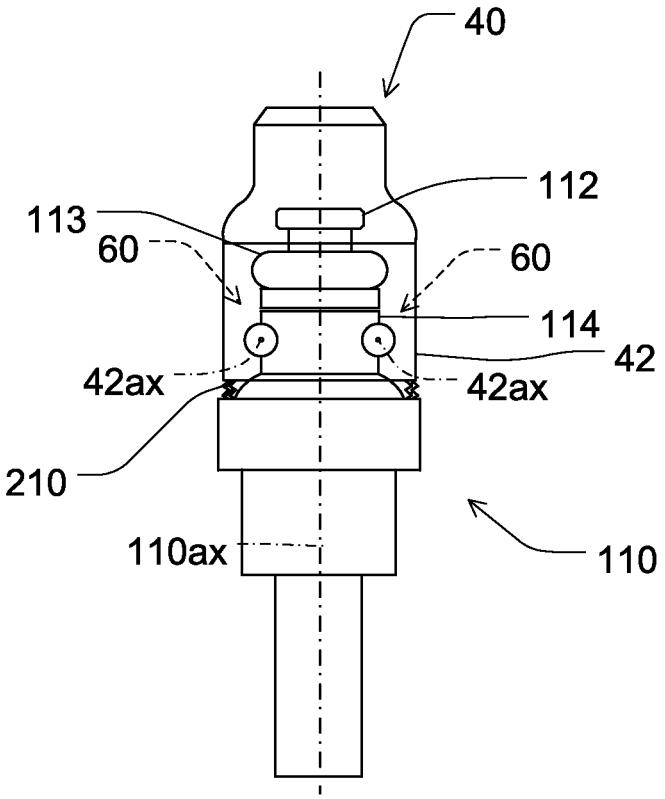
FIG. 11 is a transparent view showing an injector and a cup according to a third embodiment.
Figure 11:
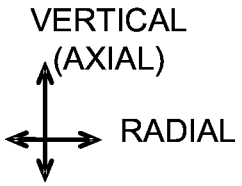

As shown in FIG. 11, a biasing element 210 may be equipped between the injector 110 and the cup 40. Specifically, the biasing element 210 may be located between the injector body 116 of the injector 110 and the bottom surface of the cup 40 to bias the injector 110 relative to the cup 40. The biasing element 210 may resiliently bias the injector 110 in a direction away from the cup 40. The biasing element 210 may be formed of a metallic material and may employ various forms such as a blade spring, a coil spring, or a bellows spring. More specifically, the biasing element 210 may be a blade spring formed of a C-shaped plate twisted to produce resilience.

Fourth Embodiment

Figure 12:
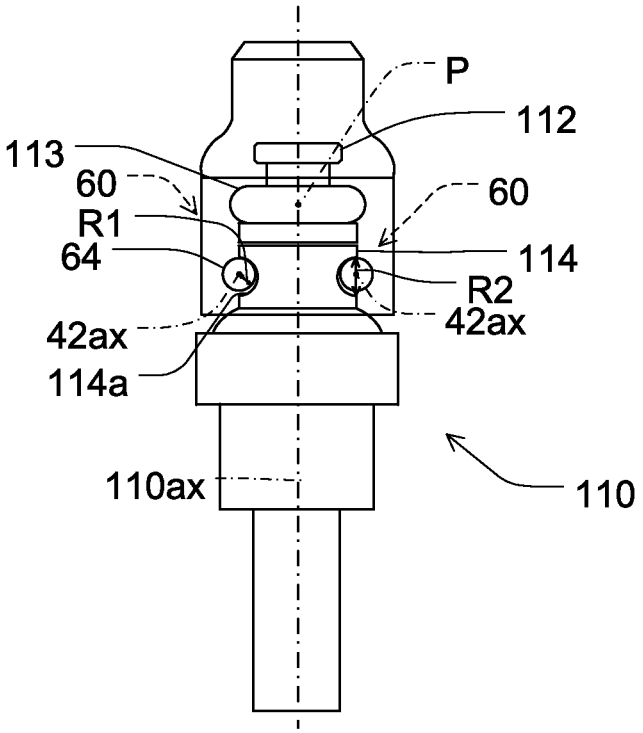
FIGS. 12 and 13 are transparent views showing an injector and a cup according to a fourth embodiment.
Figure 12:
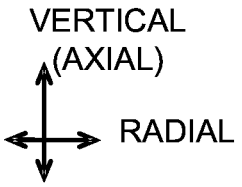

As shown in FIG. 12, the recess 114*a* may be greater than the pin body 64. Specifically, a curvature radius R2 of the recess 114*a* may be greater than a diameter of the pin body 64. In the present configuration, the pin body 64 may be partially in contact with the recess 114*a* to form a gap therebetween. The inlet end 112 of the injector 110 may have a virtual pivot center P, located on 110*ax*, at a center of the O-ring 113. The injector 110 may be configured to incline relative to the cup around the virtual pivot center P. That is, the cup 40 may permit inclination of the injector 110 centered on the virtual pivot center P.

Figure 13:
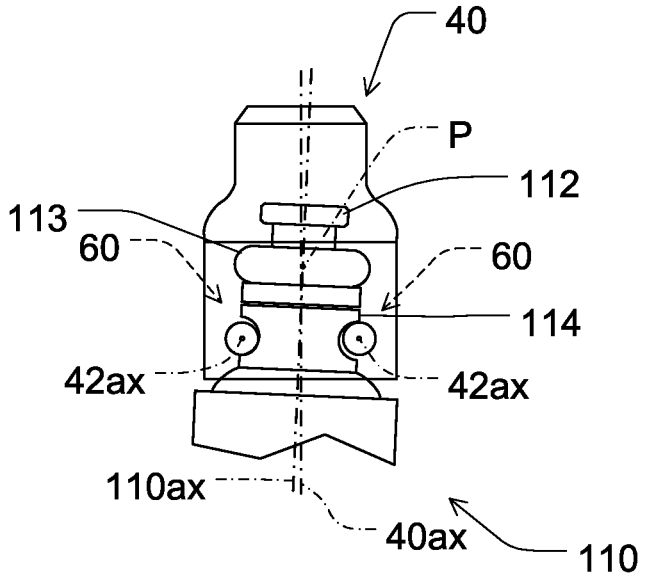
Figure 13:
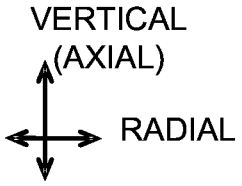

FIG. 13 shows a state in which the injector 110 is inclined relative to the cup 40. Specifically, the injector axis 110*ax* may be inclined relative to a cup axis 40*ax* of the cup 40 at an angle. The cup 40 may permit inclination of the injector 110 in an angular range, which is, for example, between minus 1.5 degree and plus 1.5 degree. The present configuration may increase a mechanical tolerance between the injector 110 and the cylinder head 102 of the engine 100.

Other Embodiment

The pin body 64 may have a non-circular cross section. For example, the cross section of the pin body 64 may one of an oval shape and a rectangular shape. Correspondingly, the apertures 42*a* may be one of an oval shape and a rectangular shape.

The features of the above-described embodiments may be arbitrarily combined with each other and/or may be replaced with each other.

It should be appreciated that while the processes of the embodiments of the present disclosure have been described herein as including a specific sequence of steps, further alternative embodiments including various other sequences of these steps and/or additional steps not disclosed herein are intended to be within the steps of the present disclosure.

While the present disclosure has been described with reference to preferred embodiments thereof, it is to be understood that the disclosure is not limited to the preferred embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. An injector device comprising:
an injector having an inlet body;
a cup in a bottomed tubular shape and configured to hold the inlet body; and
a first pin and a second pin, wherein
the cup has a sidewall defining first apertures and second apertures,
the first pin is inserted in the first apertures,
the second pin is inserted in the second apertures,
the first pin and the second pin are configured to hold the inlet body and to restrict rotation of the inlet body relative to the cup,
the inlet body has an outer periphery defining a first recess and a second recess,
the first pin and the second pin are fitted to the first recess and the second recess, respectively,
the first recess extends linearly in a direction perpendicularly to the injector axis, and
the second recess extends linearly in a direction perpendicularly to the injector axis, wherein
the first recess is dented from an outer periphery of the inlet body radially inward, and
the second recess is dented from the outer periphery of the inlet body radially inward, wherein
the first recess has a cross section in an arc shape, which coincides with a part of a cross section of the first pin, and
the second recess has a cross section in an arc shape, which coincides with a part of a cross section of the second pin.

2. The injector device of claim 1, wherein
the first pin and the second pin are fitted to the inlet body to restrict rotation of the inlet body relative to the cup about an injector axis.

3. The injector device of claim 1, wherein
the first recess and the second recess are offset from a center of the injector radially outward in opposite directions.

4. The injector device of claim 1, wherein
the first apertures includes two first apertures opposed to each other to extend along a first aperture axis, and
the second apertures includes two second apertures opposed to each other to along a second aperture axis.

5. The injector device of claim 4, wherein
the first aperture axis and the second aperture axis are offset from a center of the cup radially outward.

6. The injector device of claim 1, wherein
each of the first pin and the second pin is in an elongated bar shape extending linearly.

7. The injector device of claim 6, wherein
each of the first pin and the second pin has a pin end, a pin body, and a pin head,
the pin body has a circular cross section,
the pin end is located at one end of the pin body, the pin end being reduced in diameter from a side of the pin body toward a tip end of the pin end, and the pin head is located at an other end of the pin body, the pin head being in a plate shape and being greater than the pin body in size.

8. The injector device of claim 6, wherein each of the first pin and the second pin has a pin end, a pin body, and a pin head, and the pin body has a non-circular cross section in an oval shape or a rectangular shape.

9. The injector device of claim 6, wherein each of the first pin and the second pin has a pin end, a pin body, and a pin head, and the pin head is greater than corresponding one of the first apertures and the second apertures in size.

10. The injector device of claim 1, further comprising:

a biasing element configured to bias the injector relative to the cup.

11. The injector device of claim 1, wherein the cup is configured to permit inclination of the injector about a virtual pivot center.

12. The injector device of claim 11, further comprising:

an O-ring equipped to an inlet end of the injector to seal between the inlet end and the cup, and the inlet end has the virtual pivot center at a center of the O-ring, on the injector longitudinal axis.

13. The injector device of claim 1, wherein the first apertures are through holes, respectively, and the first pin extends through the first apertures.

14. The injector device of claim 1, wherein one of the first apertures is a through hole, an other of the first apertures is a dent opening in an inner periphery of the sidewall, the first pin extends through the one of the first apertures, and the first pin resides at an end within the other of the first apertures.

* * * * *